US007216726B2

(12) United States Patent
Swietlik et al.

(10) Patent No.: US 7,216,726 B2
(45) Date of Patent: May 15, 2007

(54) DOWNHOLE FLUID-TIGHT FLEXIBLE JOINT

(75) Inventors: George Swietlik, Lowestoft (GB); Joseph Fitzgerald, Lowestoft (GB)

(73) Assignee: Pilot Drilling Control Limited, Lowestoft (GB)

( * ) Notice: Subject to any disclaimer, the term of this patent is extended or adjusted under 35 U.S.C. 154(b) by 0 days.

(21) Appl. No.: 10/166,132

(22) Filed: Jun. 10, 2002

(65) Prior Publication Data

US 2003/0024742 A1 Feb. 6, 2003

(30) Foreign Application Priority Data

Jun. 12, 2001 (GB) ..... 0114354.4

(51) Int. Cl.
*E21B 17/02* (2006.01)

(52) U.S. Cl. ..... 175/73; 175/74; 175/325.2; 175/325.3; 175/79; 175/83; 464/173; 285/118

(58) Field of Classification Search ..... 175/74, 175/256, 73, 325.1–325.3, 79, 81–83, 320; 285/118; 464/173; 166/242.2
See application file for complete search history.

(56) References Cited

U.S. PATENT DOCUMENTS 1,660,999 A * 2/1928 MacDonell ..... 175/79
2,296,161 A * 9/1942 Hall, Jr. ..... 175/74
2,730,328 A * 1/1956 Brown ..... 175/73
3,196,959 A * 7/1965 Kammerer ..... 175/73
3,446,297 A * 5/1969 Elliott et al. ..... 175/320
3,893,523 A * 7/1975 Jeter ..... 175/74
4,007,797 A * 2/1977 Jeter ..... 175/26
4,303,135 A * 12/1981 Benoit ..... 175/256
5,836,388 A * 11/1998 Tchakarov ..... 175/73
5,911,283 A 6/1999 Cousins et al.
5,941,321 A * 8/1999 Hughes ..... 175/76
6,116,337 A 9/2000 Civarolo et al.
6,135,215 A * 10/2000 Ericksen ..... 175/73
6,234,259 B1 * 5/2001 Kuckes et al. ..... 175/73
6,321,857 B1 * 11/2001 Eddison ..... 175/325.3
6,550,818 B2 * 4/2003 Robin ..... 175/74

* cited by examiner

*Primary Examiner*—David Bagnell
*Assistant Examiner*—Matthew J. Smith
(74) *Attorney, Agent, or Firm*—Seyfarth Shaw LLP

(57) ABSTRACT

A downhole tool comprises a joint, and a resilient member 65 which extends through the joint and provides a restoring force which tends to strengthen the joint. The joint may comprise a flex coupling 61 which allows limited articulation of the joint. First and second drill string sections 63, 64 may be interconnected by the joint, the resilient member 65 being fixed to interior surfaces of the first and second drill string sections 63, 64. A downhole tool may also comprise primary and secondary sleeves 46 that are supported relative to the mandrel 10 of the drill string. Rotational drive may be transferred from one of the sleeves to the other.

14 Claims, 10 Drawing Sheets

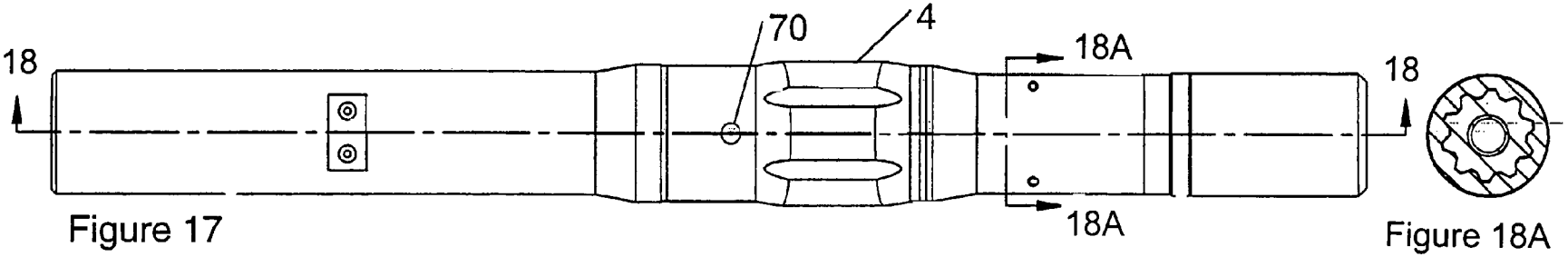
Figure 17
Figure 18A
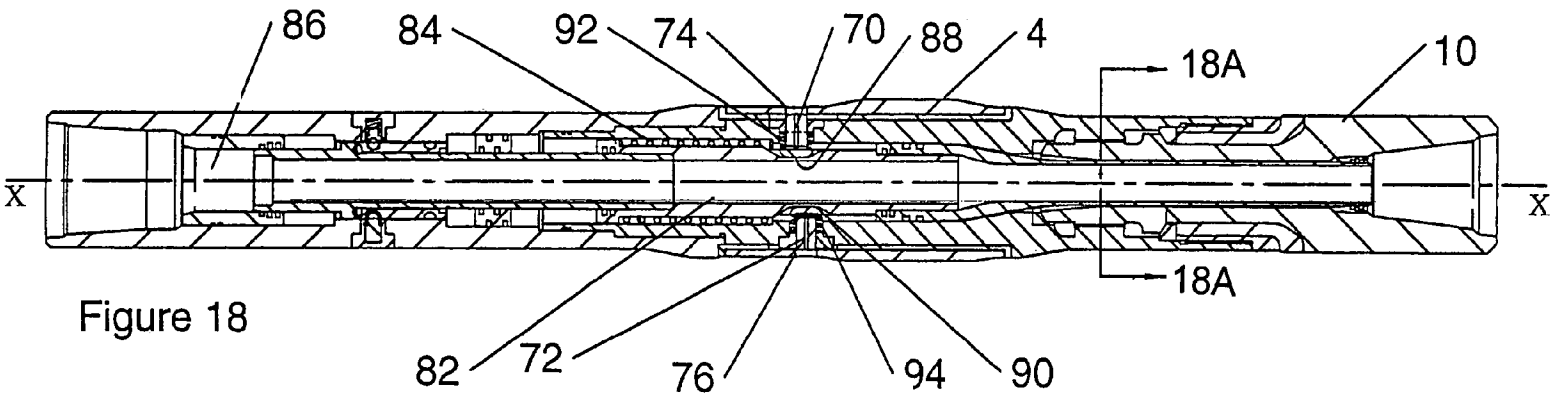
Figure 18

DOWNHOLE FLUID-TIGHT FLEXIBLE JOINT

BACKGROUND OF THE INVENTION

This invention relates to improvements to steerable downhole tools and particularly, although not exclusively relates to a device for locking and unlocking an asymmetrical offset sleeve relative to a drill string which rotates within it.

It is known to provide a steering device on the lower end of a drill string in order to steer the borehole away from the vertical. In certain circumstances, it is desirable to steer the drill bit in a short radius curve, in order to avoid certain rock structures or to tap into or drain smaller pockets of oil or gas. Many systems have been proposed for short radius curve drilling. One of these utilises a mud rotor to rotate a drill bit. The drill bit is tilted relative to the wellbore centreline, so that it drills a curved path. The rotational orientation of the motor housing in the borehole determines the direction of the curve of the borehole, so some means must be provided in this system to keep the motor housing oriented while drilling.

An alternative system for short radius curve drilling comprises what is known as a "constrained-rotary" drilling system. This system employs a flexible drive shaft which rotates inside an articulated non-rotating housing. A "curve guide" made of resilient material acts as a spring to apply a side force to the bit and thereby to cause the bit to drill a curved path.

A further system for short radius curve drilling comprises the "rotary-guided" system, in which a flexible drill collar is oriented by specialist downhole equipment. In this system, the flexible joint is provided in the drill string towards it lower end and the flexible joint is pushed towards one side of the hole to tilt the bit. The pushing force can be provided by a standard mule-shore sub for gyro orienting and a non-magnetic mule-shoe sub for magnetic orienting. This system is generally considered cheaper than the above-described methods. However, there are significant disadvantages in the systems currently available. These are:

1. The orientation equipment is not sufficiently stable and can therefore rotate slightly with the drill string thereby causing the borehole to veer off from its desired direction.

2. If the orientation equipment loses its grip significantly it can rotate around the bore hole in an uncontrolled fashion, gouging out the sides of the borehole.

3. No satisfactory means has been devised for biasing the flexible joint into a straight orientation, so that the assembly does not necessarily return to straight drilling, if the side force on the flexible joint provided by the orientation equipment is removed.

The prior systems have relied on rotary seals to seal the interior of the drill string relative to the exterior of the drill string. These rotary seals have caused maintenance and reliability problems and it would be preferably if they could be avoided.

In the prior art devices, means must be provided to latch and unlatch the orientation equipment relative to the rotating drill string. As the drill string can be rotating at speeds of from 100 to 300 rpm, and as the torque on the drill string as the drill bit advances can be enormous, reliable direct latching and unlatching of the orientation equipment relative to the drill string is difficult to achieve.

The various aspects of the present invention have been developed with these disadvantages in mind.

SUMMARY OF THE INVENTION

According to the first aspect of the present invention there is provided a downhole tool comprising a joint and a resilient member which extends through the joint and provides a restoring force which tends to straighten the joint.

Preferably, the joint comprises a flexible joint, and may for example comprise a loose splined connection which allows limited articulation of the joint. Preferably, the range of articulation is from 1 to 5 degrees from a longitudinal centreline of a downhole tool. Most preferably, the maximum articulation is 3 degrees.

Preferably, the downhole tool further comprises a first drill string section and a second drill string section, the first and second drill string sections being interconnected by the joint, the resilient member being bonded, bolted or otherwise fixed to interior surfaces of the first and second drill string sections.

Preferably, the resilient member is tubular. Preferably the resilient member comprises a fluid tight tube which is sealed to the said interior surfaces of the first and second drill string sections. The resilient member may, for example, be made from an elastomer, plastic material and/or rubber material.

According to a second aspect of the present invention there is provided a downhole tool comprising primary and secondary sleeves which are supported for rotation relative to the mandrel of the drill string, means being provided to transfer rotational drive from one of the sleeves to the other.

Preferably, the primary sleeve is spaced from and is adjacent to the secondary sleeve in a longitudinal direction of the drill string.

Preferably, the primary sleeve comprises a drill string stabiliser. Preferably, the primary sleeve is or can be made eccentric relative to a rotational axis of the mandrel. For example, the sleeve may be made such that one side of the sleeve projects radially outwardly further than the opposite side of the sleeve. Alternatively, the sleeve may be provided with a retractable projection which can be forced outwardly to apply pressure to a side of the borehole.

Preferably, the drive means comprises a gear wheel. Preferably, the gear wheel is mounted on the mandrel, and/or rotates in a plane parallel to a rotational axis of the mandrel, and/or engages respective gears formed around the primary and secondary sleeves.

Preferably, the gear wheel comprises a large gear wheel and a smaller gear wheel, so that there is a gear ratio between the primary sleeve and the secondary sleeve. Preferably, the gear wheels are superimposed one on top of the other. Preferably, the gear wheels are integrally formed and may be machined from a single piece of metal.

Preferably, the large gear wheel engages only the gear on the secondary sleeve and the small gear wheel engages only the gear on the primary sleeve or vice versa. With this arrangement, rotation of the secondary sleeve in a first direction causes rotation of the primary sleeve in the opposite direction.

Preferably, there are a plurality of gear wheels. Preferably the gear wheels are equidistantly spaced around the circumference of the mandrel.

Preferably, there are two gear wheels which are mounted on a driveshaft which passes through the mandrel, one of the gear wheels engaging only a gear formed on the primary sleeve and the other gear wheel engaging only a gear formed on the secondary sleeve. Preferably, the gears are of different diameters and/or have a different number and/or size of teeth.

Preferably, the gears formed on the primary and secondary sleeves are ring gears which may be formed on the ends of the sleeves which are adjacent one another.

Preferably, the driveshaft runs through a tube which extends across the mandrel substantially at right angles to the rotary axis of the mandrel. Open ends of the tube may be sealed to the mandrel, so that the interior surface of the mandrel is sealed from the exterior surface of the mandrel.

Preferably, the primary and second sleeves are each mounted on respective bearings located in or on the outer surface of the mandrel.

Preferably, an annular cover is provided over the gear wheels. The cover may be sealed to the mandrel and/or to one or both sleeves. Preferably, the cover is free to rotate relative to the mandrel and/or relative to one or both sleeves.

Preferably, the outside diameter of the cover is larger than the outside diameter of the secondary sleeve. Consequently, in operation of the downhole tool, the projecting portion of the primary sleeve engages one side of the borehole and the cover engages the other side of the borehole at a position displaced approximately 180 degrees from the point of engagement of the primary sleeve with the borehole.

In an alternative arrangement, the outside diameter of the secondary sleeve is greater than the outside diameter of the cover (or no cover is provided). In this arrangement the secondary sleeve engages the other side of the borehole at a position displaced approximately 180 degrees from the point of engagement of the primary sleeve with the borehole.

Preferably, means is provided for locking or braking one or both sleeves relative to the mandrel. The said means may comprise a pine which is housed in the mandrel and engages in an opening in the sleeve to lock the sleeve relative to the mandrel. Preferably, at least two pins are provided to lock the sleeve. Preferably, the pins are of different size and/or are spaced apart in a direction parallel to a rotational axis of the mandrel and/or are spaced apart asymmetrically around the circumference of the mandrel.

Preferably, the or each pin is driven radially outwardly into engagement with the sleeve by an actuating mechanism. Alternatively, the or each pin is driven in a direction substantially parallel to the rotational axis of the mandrel by an actuating mechanism. For example, the pin may engage in a recess formed in an end of the sleeve.

The actuating mechanism may be of any suitable type and may, for example, comprise a simple "lock-on/lock-off" mechanism which is operated by changes in fluid pressure applied to the actuating mechanism. Alternatively, the actuating mechanism may comprise a more sophisticated sliding sleeve arrangement comprising a ball assembly which is driven on an endless track between a series of rest positions which define operative states of the device. Preferably, the motive force to cycle the sliding sleeve arrangement is provided by changes in fluid pressure applied to the actuating mechanism. Preferably, the said fluid comprises drilling fluid which may be pumped down the drill string in the interior of the mandrel.

According to a third aspect of the present invention, there is provided a downhole tool comprising a sleeve rotatably mounted on a mandrel of a drill string, means being provided for locking or braking the sleeve relative to the mandrel, the said means comprising a locking member which moves in a direction substantially perpendicular to a radial direction of the mandrel to lock or unlock, brake or release the sleeve. As the locking member moves in a direction which is substantially perpendicular to a radial direction of the mandrel, in the unlocked position, the locking member does not need to project into the mandrel and there is no need to provide a fluid tight seal to the interior of the mandrel.

According to a fourth aspect of the present invention, there is provided a downhole tool comprising a sleeve rotatably mounted on a mandrel of a drill string, and a gear wheel rotatably mounted on the mandrel in a plane substantially parallel to a rotational axis of the mandrel, the gear wheel engaging a ring gear formed on an end of the sleeve, such that rotation of the gear wheel causes rotation of the sleeve and vice versa. Preferably, the gear wheel is driven to rotate the sleeve a predetermined amount relative to the mandrel. Alternatively, the gear wheel can provide feedback on the position of the sleeve relative to the borehole.

In a preferred arrangement, the gear wheel is rotated by means of an impeller located within a flow of fluid in the mandrel. Preferably, the impeller is connected to the gear wheel by means of a driveshaft.

According to a fifth aspect of the present invention, there is provided a downhole tool comprising a rotatable mechanism, a mandrel and an impeller rotatably mounted in the mandrel, and means for pumping fluid through the mandrel to rotate the impeller and thereby to operate the rotatable mechanism.

According to a sixth aspect of the present invention, there is provided a downhole tool which incorporates a flex joint (for example for directional control, vibration control or to accommodate high bend hole curvatures) wherein within the flex joint there is a resilient flow tube which acts as a spring to restore the systems straightness once the lateral force has been reduced or removed.

According to a seventh aspect of the present invention, there is provided a downhole tool that deploys two sleeves one eccentric with either a fixed or expandable/retractable offset blade or pad and the other concentric. The diameters and or circumferences of each are such that the only part of the eccentric sleeve that makes contact with the formation is the offset blade/pad whilst the portion of the circumference on the concentric sleeve makes contact with the formation at 180 degrees—directly opposite—from the offset pad.

According to an eighth aspect of the present invention, there is provided a downhole tool that deploys two sleeves one eccentric with either a fixed or expandable/retractable offset blade or pad and the other concentric. The diameters and or circumferences of each are such that the only part of the eccentric sleeve that makes contact with the formation is the offset blade/pad whilst a portion of the circumference and an Outer Ring mounted on the Idler Wheel makes contact with the formation at 180 degrees—directly opposite—from the offset pad.

According to a ninth aspect of the present invention, there is provided a downhole tool that deploys concentric or eccentric sleeves wherein one or the other is mounted able the other up from the drill bit.

According to a tenth aspect of the present invention, there is provided a downhole tool that uses two sleeves independently mounted on bearings on a main body mandrel and that can be locked onto the mandrel either independently or both at the same time via a downhole mechanism.

According to an eleventh aspect of the present invention, there is provided a linkage drive system between two independently mounted sleeves which allows for selective rotational forward or backward drive between the two sleeves or the locking together of the sleeves such that they may rotate in phase and at the same speed as the main mandrel body.

According to a twelfth aspect of the present invention, there is provided a linkage drive system between two independently mounted sleeves which allows for selective rotational forward or backward drive between the two sleeves or the locking together of the sleeves such that one sleeve may rotate in phase or direction and at the same speed as the main mandrel body.

According to a thirteenth aspect of the present invention, there is provided a Linkage Drive between two sleeves that may also be driven by the fluid flow of drilling mud through the centre of the pipe.

According to a fourteenth aspect of the present invention, there is provided a downhole tool comprising two sleeves mounted on a main mandrel and a drive linkage which links the sleeves (preferably an offset sleeve and a slave sleeve) to each other in such a way as to cause the slave sleeve to rotate differentially to the rotation of the main body. With this arrangement, if the slave sleeve is braked or locked the offset sleeve repositions itself in orientation when static; i.e. which not being rotated at the same speed and in the same direction as the main body.

Embodiments in accordance with various aspects of the present invention provide a simple tool which could be used as an inexpensive and easy to develop "3-D Point the Bit" tool and allows dynamic re-orienting of the sleeve whilst in the de-latched position.

The tool can be configured with a rotating/non rotating offset stabiliser sleeve mounted above a torsionally rigid flex joint. The flex joint is preferably calibrated to deflect laterally over a range of angles against known side load values. Within the flex joint is a resilient member which may comprise a tube. If it is configured as a tube, it has a dual purpose by providing:

A) A restoring spring force to a straighten the joint to a dead ahead position

B) A conduit for the drilling fluid to pass through without leakage.

In a preferred embodiment of the present invention, the tool is made up of the 3 main housing component parts:

Lower Flex Joint Mandrel c/w mail Drive Coupling

Upper Flex Hsng c/w integral female Drive Coupling & Latchable Offset Sleeve

Latching Operating Mechanism Housing

The main subsidiary parts in each section:

Lower Flex Joint
Nut (1)
Lower Contact/Off Bottom Ring (2)
Lateral Elastomer Ring (3)
Security Ring (4)
Seal Carrier (5)

Upper Flex Housing
Bearing & Sleeve (6)
Latch Pins & Bushes (7)
Lower Contact/On Bottom Ring & Elastomer (8)
Spring/Flow Tube (9)

Latching Operating Housing
Cam Sleeve sub-assembly (10)
Nozzle (11)
Spring (12)
Comp. Piston (13)
Latch Pin Drive Shaft (14)
Bushes (15)

In this embodiment the number of component parts is minimised to save cost and reduce complexity. Another issue was to avoid rotary seals and therefore in this embodiment no attempt has been made to provide clockwise and anti-clockwise correction control of the sleeve.

In one embodiment the sleeve is machined with a fixed offset. The advantage of this over an embodiment with an expanding/retractable pad on the sleeve is its simplicity. The latching and de-latching of the sleeve can be provided through a pumps on—pumps off cycling process where a closed loop cam either allows the mechanism to fall or remain static when the pumps are switched on. This in turn activates pins to engage or disengage from the sleeve. These pins can either latch from underneath or from the side.

The sleeve may have a magnetic pick up which aligns with a magnetic sensor on the mandrel body when it is locked in the appropriate orientation position to the mandrel body. This ensures accurate and reliable alignment.

Various objects and advantages of this invention will become apparent to those skilled in the art from the following detailed description of the preferred embodiments, when read in light of the accompanying drawings.

BRIEF DESCRIPTION OF THE DRAWINGS

FIG. 17 is a side view of the locking arrangement of FIG. 16;

FIG. 18 is a cross-section on the line 18—18 of FIG. 17;

FIG. 18A is a cross-section on the line 18A—18A of FIGS. 17 and 18;

DETAILED DESCRIPTION OF THE PREFERRED EMBODIMENT

Figure 4:
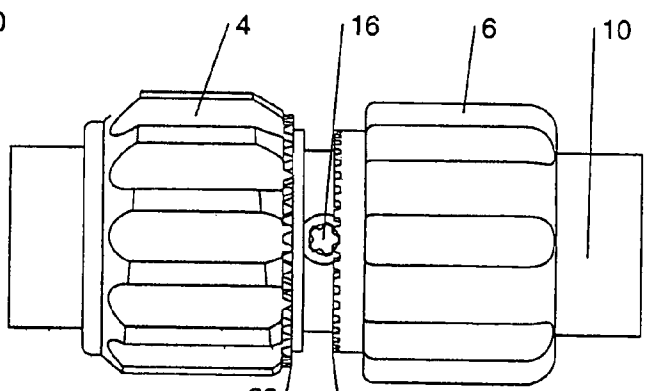
FIG. 4 is a view of the other side of the cross shaft drive assembly.
Figure 3:
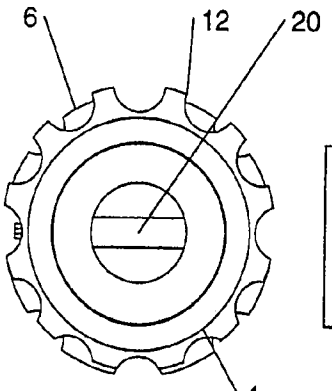
FIG. 3 is a cross-section on the line 3—3 in FIG. 1.
Figure 5:
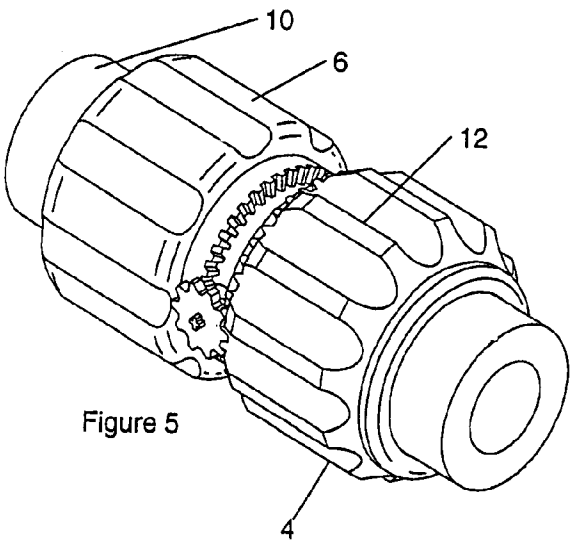
FIG. 5 is a perspective view of the cross shaft drive assembly.
Figure 1:
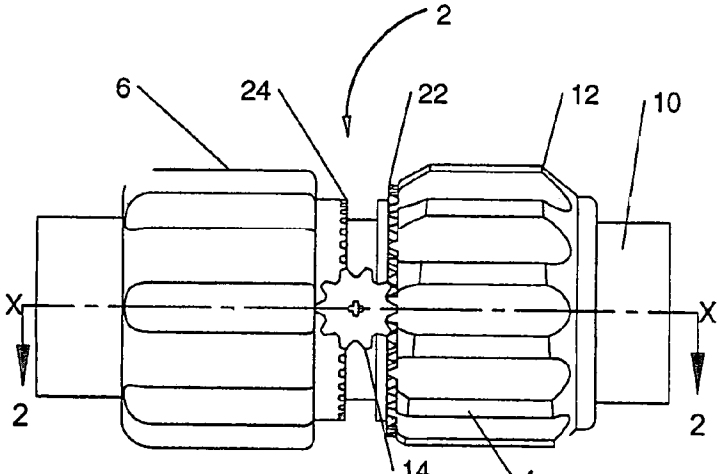
FIG. 1 is a side view of the cross shaft drive assembly providing drive between two sleeves mounted on a drill string mandrel.
Figure 2:
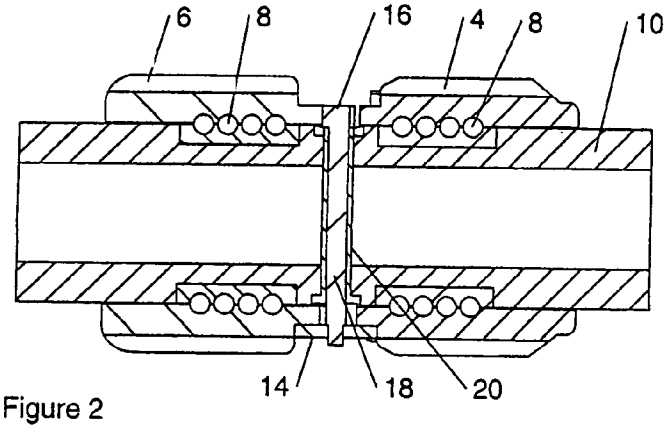
FIG. 2 is a cross-section on the line 2—2 in FIG. 1.

FIGS. 1 to 5 show a cross shaft drive assembly 2 comprising an offset sleeve 4 and a slave sleeve 6 which are mounted on bearings 8 on a mandrel 10 of a drill string. The slave sleeve 6 is concentric relative to a rotational axis X—X of the drill string, whereas the offset sleeve 4 is not concentric and is provided with a raised portion 12 which extends radially outwardly from the rotational axis X—X of the drill string further than the remainder of the offset sleeve 4.

A pair of idler gear wheels 14, 16 provide a rotational interconnection between the offset sleeve 4 and slave sleeve 6. The idler gear wheels 14, 16 are rigidly interconnected by means of a cross shaft 18 located in a cross shaft tube 20 which extends through a central region of the mandrel 10 in a direction parallel to the rotational axis X—X of the drill string.

The larger idler gear wheel 14 engages a ring gear 22 formed on the end of the offset sleeve 4 adjacent the slave sleeve 6, whereas the smaller idler gear wheel 16 on the opposite side of the mandrel 10 engages a smaller ring gear 24 formed on the end of the slave sleeve 6 adjacent the offset sleeve 4.

In an offset drilling operation, the mandrel 10 rotates at a speed of approximately 100 to 300 rpm and the offset sleeve 4 and slave sleeve 6 main stationary with the mandrel 10 rotating within them. It will be appreciated that the offset sleeve 4 and slave sleeve 6 are a tight fit within the borehole, but because of the offset of the sleeve 4, there is only point contact with the borehole. This point contact occurs at the raised portion 12 of the offset sleeve 4, and on the portion of the slave sleeve 6 which is disposed 180 degrees around from the raised portion 12 of the offset sleeve 4. As a consequence of this point contact, the mandrel 10 is not concentric with the borehole.

If the cross shaft drive assembly forms part of a downhole tool comprising a drill bit with a flex coupling, the offsetting of the mandrel 10 in relation to the borehole causes the drill bit to drill a curved hole. If the direction of drilling is to be altered, it is necessary to rotate the offset sleeve 4, so that the raised portion 12 engages the borehole at a different rotational position. In this embodiment, rotation of the offset sleeve 4 is achieved by braking or locking the slave sleeve 6 relative to the mandrel 10. This can be achieved by applying a brake shoe or other braking device to the inside surface of the slave sleeve 6 or by forcing a pin in the mandrel 10 into the slave sleeve 6. Various mechanisms for achieving this are discussed later.

With the slave sleeve 6 braked or locked to the mandrel 10, the slave sleeve 6 rotates with the mandrel 10, and by engagement of the ring gear 24 with the small idler gear wheel 16, the cross shaft 18 is caused to rotate and thereby to drive the larger idler gear wheel 14 to rotate. This in turn causes rotation of the offset sleeve 4, by engagement of the ring gear 22 with the larger idler gear wheel 14. In this embodiment, the offset sleeve 4 is caused to rotate in the same direction as the slave sleeve 6 and the mandrel 10, but because of the difference in size between the larger idler gear wheel 14 compared to the smaller idler gear wheel 16, there is a gear ratio between the offset sleeve 4 and the slave sleeve 6, so that the offset sleeve 4 turns faster than the slave sleeve 6. Of course any combination of sizes of the idler gear wheels can be selected to provide any desired gear ratio between the offset sleeve 4 and slave sleeve 6.

Once the raised portion 12 of the offset sleeve 4 has been rotated into the correct position, the slave sleeve 6 can be unbraked or unlocked, so that the slave sleeve 6 and offset sleeve 4 again come to rest in the borehole.

Figure 6:
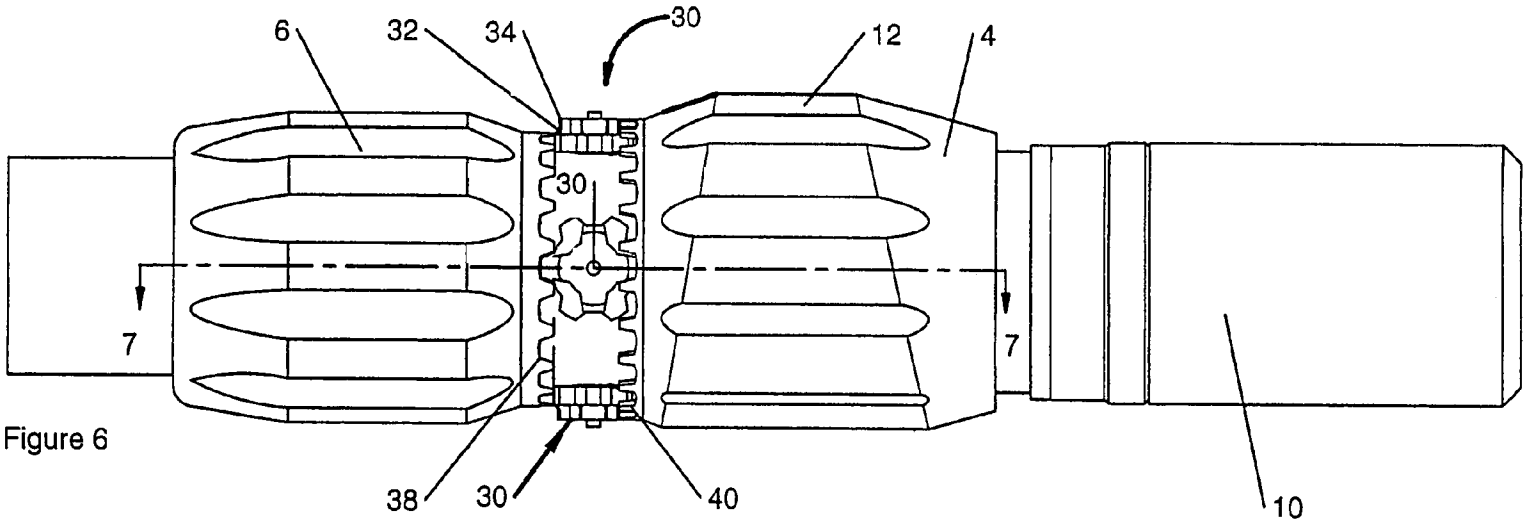
FIG. 6 is a side view of an idler gear drive assembly providing drive between two sleeves mounted on a drill string mandrel.
Figure 7:
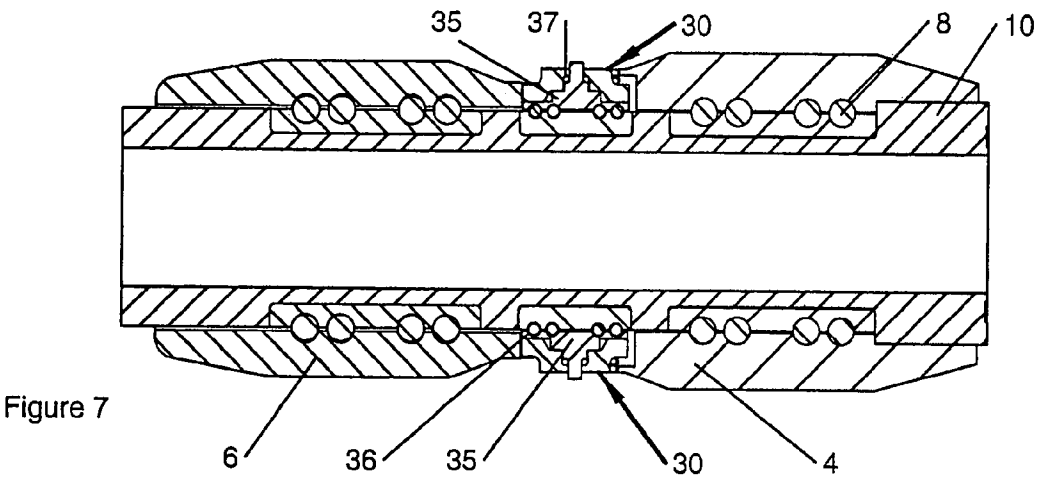
FIG. 7 is a cross-section on the line 7—7 of FIG. 6.

FIGS. 6 and 7 show an alternative embodiment of sleeve drive assembly in which the idler gears are not rigidly connected together. In this and later embodiments, the same reference numerals have been used as in the previous embodiment for the corresponding components, and the operation of the assembly is identical to the previous embodiment except where stated otherwise.

Four idler gear wheels 30 comprising a large gear 32 integrally machined with a smaller gear 34 are equidistantly spaced around the mandrel 10 on a collar 35. The collar 35 is mounted by means of bearings 36 on the mandrel 10, so it is free to rotate about the mandrel 10 and each idler gear wheel 30 is mounted by means of bearings 37 on the collar 35. The larger gears 32 of each idler gear wheel 30 engage with a ring gear 38 formed on an end of a slave sleeve 6 which is adjacent an offset sleeve 4. Similarly, the smaller gears 34 of each idler gear wheel 30 engage a ring gear 40 formed on an end of the offset sleeve 4 adjacent the slave sleeve 6.

As in the previous embodiment, in normal operation, the mandrel 10 is rotating and the slave sleeve 6 and offset sleeve 4 are stationary in the borehole. It is necessary to rotate the offset sleeve 4, so that the raised portion 12 of the offset sleeve 4 is rotated relative to the borehole, in order to change the direction of drilling. This is achieved by locking the slave sleeve 6 with the mandrel 10, so that the slave sleeve 6 turns with the mandrel 10. This causes the idler wheels 30 to rotate by engagement of the large gear wheels 32 of the idler gear wheels 30 with the ring gear 38. Consequently, the offset sleeve 4 is caused to rotate by engagement of the ring gear 40 with the small gear wheels 34 of each idler gear wheel 30. In this embodiment, the offset sleeve 4 is driven to rotate in a direction opposite to the direction of the slave sleeve 6 and there is a gearing effect caused by the difference in size of the large gear wheels 32 compared to the small gear wheels 34 of each idler gear wheel 30, such that the offset sleeve 4 rotates slower than the slave sleeve 6.

Figure 8:
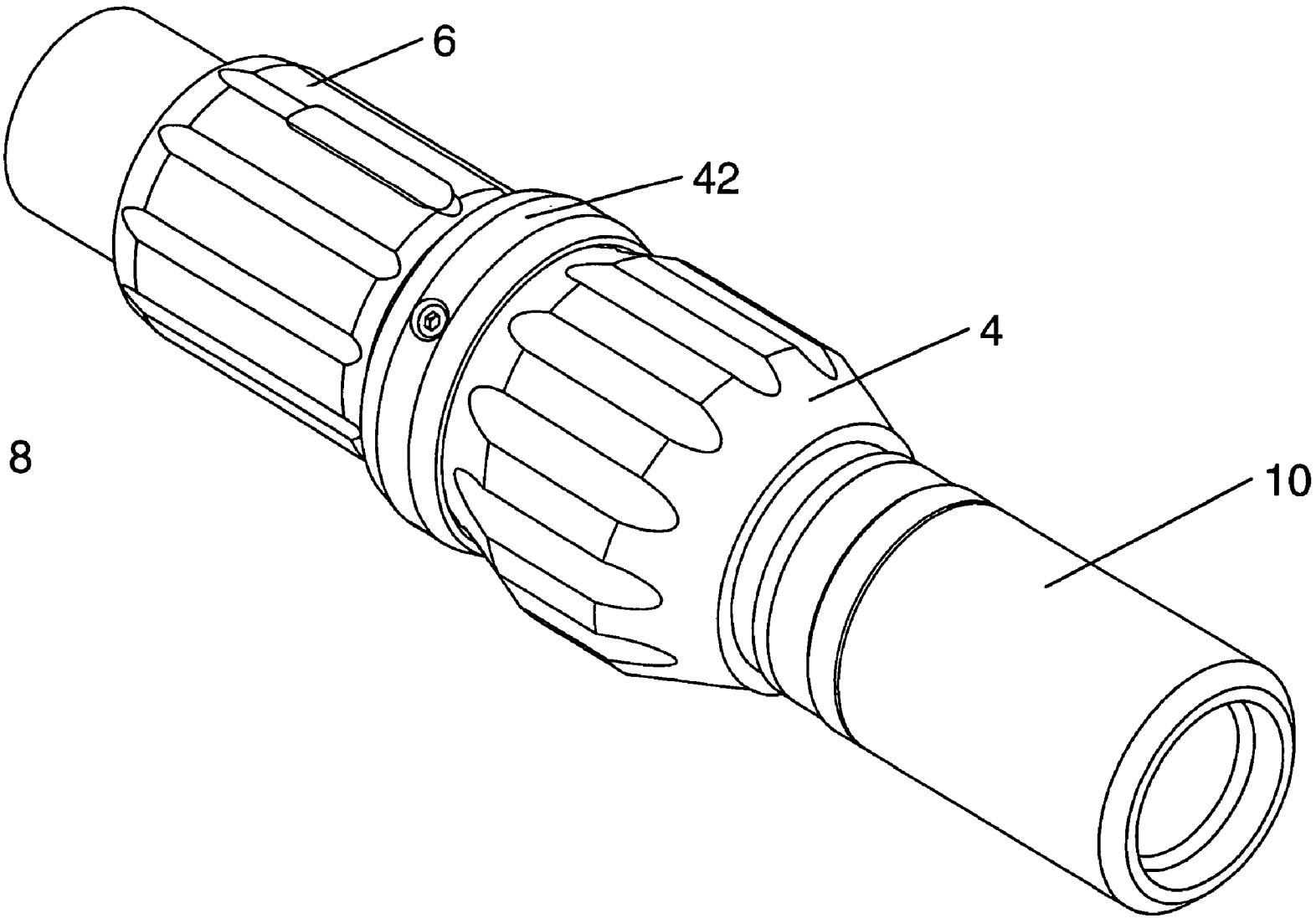
FIG. 8 is a perspective view of an enclosed drive assembly providing drive between two sleeves mounted on a drill string mandrel.
Figure 9:
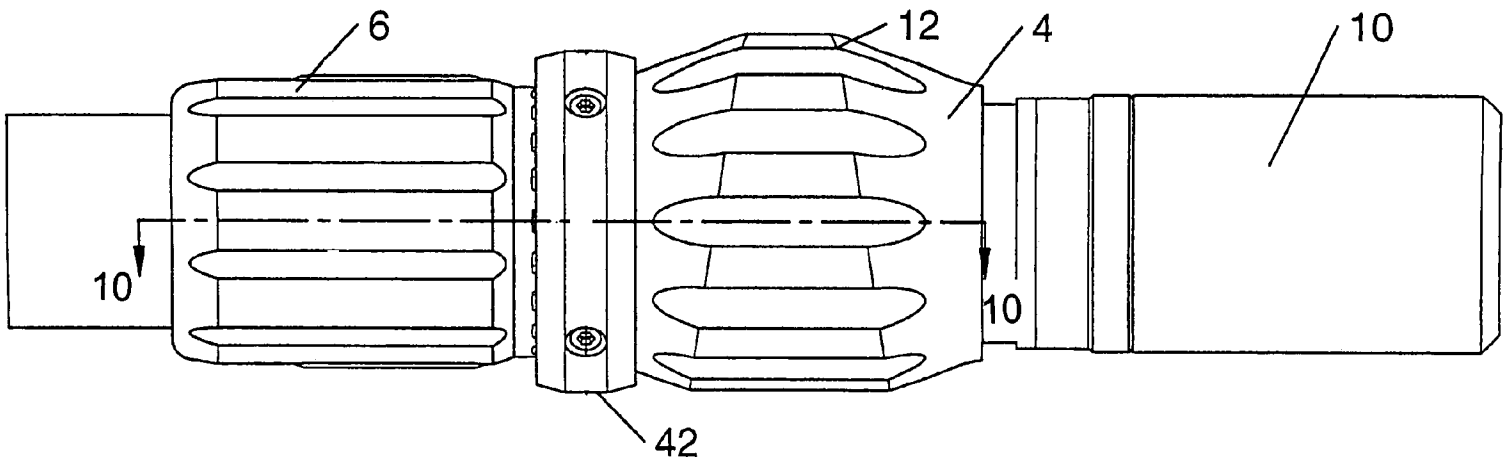
FIG. 9 is a side view of the drive assembly of FIG. 8.
Figure 10:
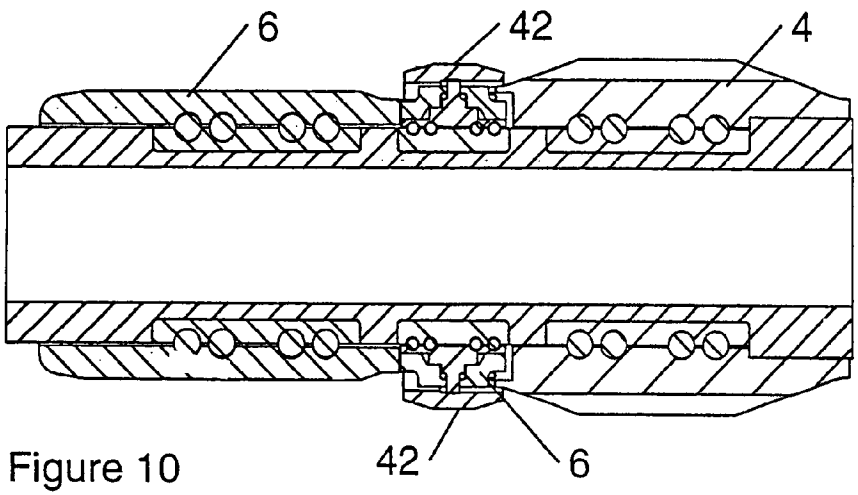
FIG. 10 is a cross-section on the line 10—10 in FIG. 9.

FIG. 8 shows an alternative embodiment of sleeve drive assembly which is identical to the last embodiment, apart from the inclusion of a curve 42 which fits over and encloses the idler gear wheels 30.

In a preferred embodiment, the outside diameter of the cover 42 is larger than the outside diameter of the slave sleeve 6, so the cover 42 engages the borehole rather than the slave sleeve 6.

Although the above embodiments describe the use of four idler gear wheels 30, each comprising a large gear wheel 32 integrally formed with a smaller gear wheel 34, any number of idler gear wheels 30 is contemplated. Indeed, in certain applications only a single idler gear wheel 30 would be adequate. Furthermore, each idler gear wheel 30 could comprise a single gear or gears of any combination of sizes integrally formed or otherwise connected together. Also the gears could be bevel gears or could comprise friction drive elements without gear teeth.

Figure 11:
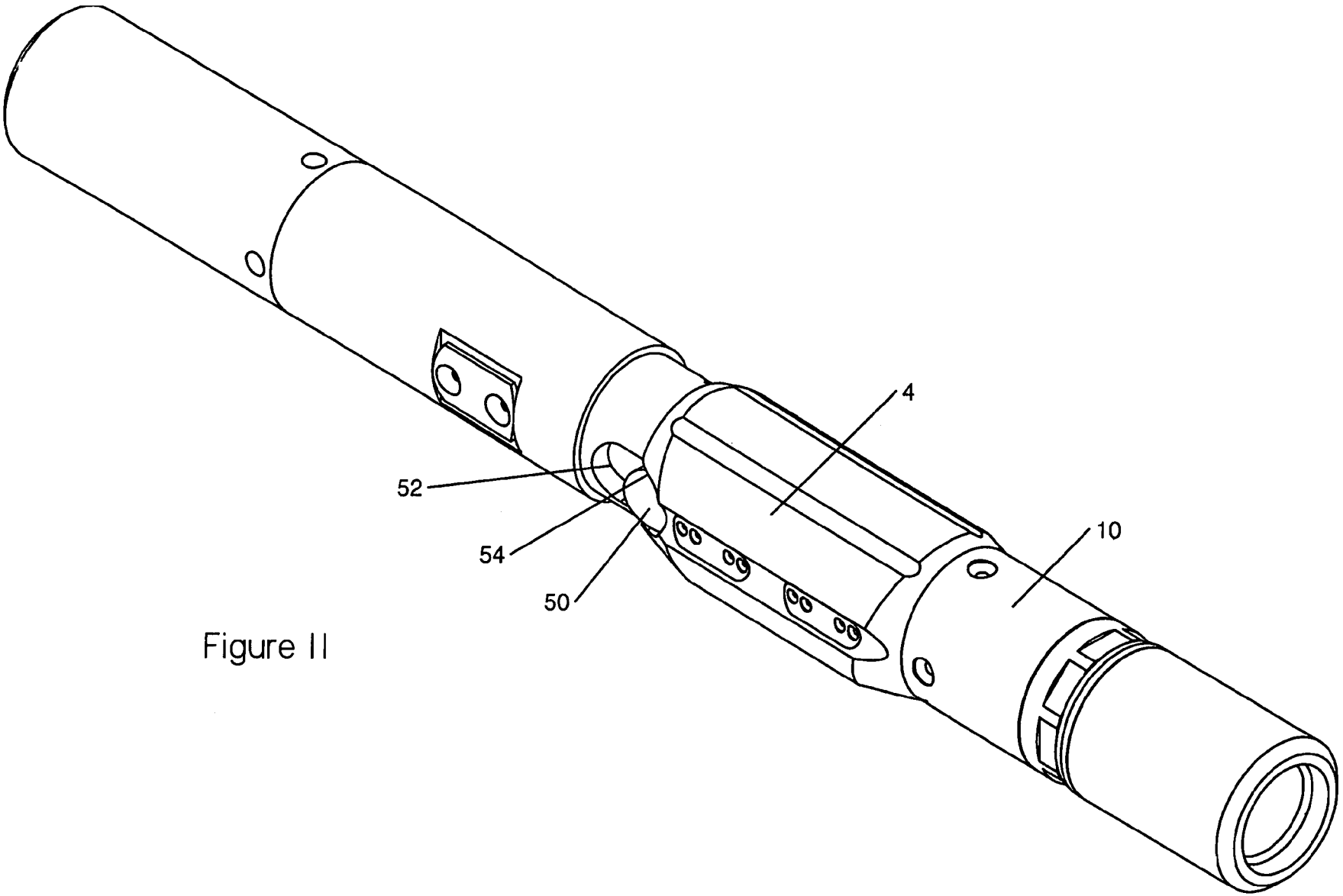
FIG. 11 is a perspective view of a locking mechanism which is operable to prevent relative rotation between a sleeve and a mandrel.
Figure 15:
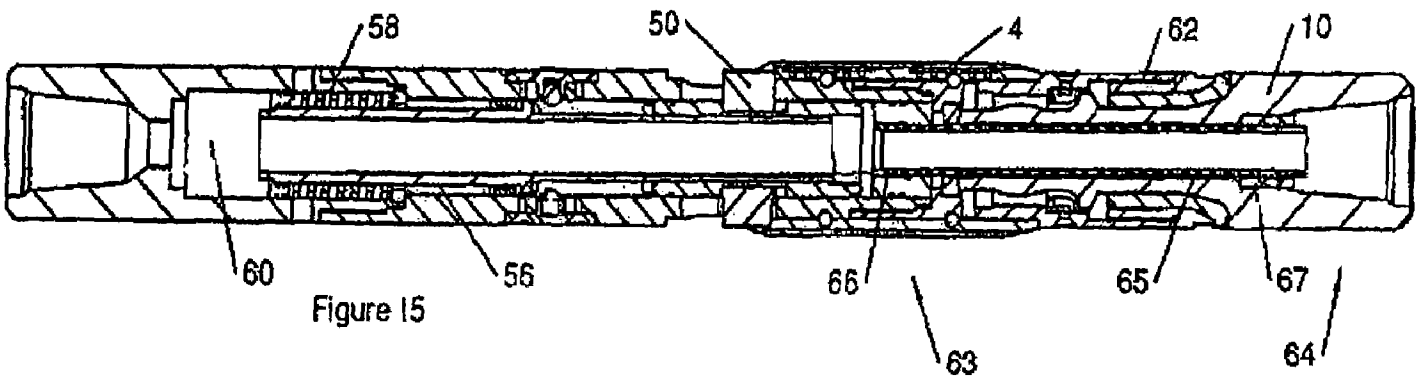
FIG. 15 is a cross-section on the line 15—15 of FIG. 14.
Figure 14:
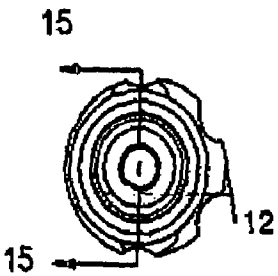
FIG. 14 is a view on an end of the offset sleeve illustrated in FIG. 12.

In the above embodiments, there is a description of how the slave sleeve 6 may be braked or locked relative to the mandrel 10. It is also contemplated that the offset sleeve 4 may be braked or locked directly to the mandrel 10. Referring to FIGS. 12 to 15, locking of either the slave sleeve 6 or the offset sleeve 4 is provided a lock pin 50 located in a recess 52 formed in the mandrel 10, and movable from an unlocked position into a locked position (as illustrated in FIG. 11) in a direction parallel to the rotational axis X—X of the mandrel 10. In the locked position, the pin 50 engages a corresponding recess 54 formed in the offset sleeve 4. As best shown in FIG. 15, the pin 50 is forced from the unlocked to the locked position by means of any appropriate downhole actuating mechanism, such as a simple "push-on push-off" piston arrangement 56. This piston arrangement 56 is moved against the action of a return spring 58 by means of changes in fluid pressure within the hollow interior 60 of the mandrel 10.

Figure 12:
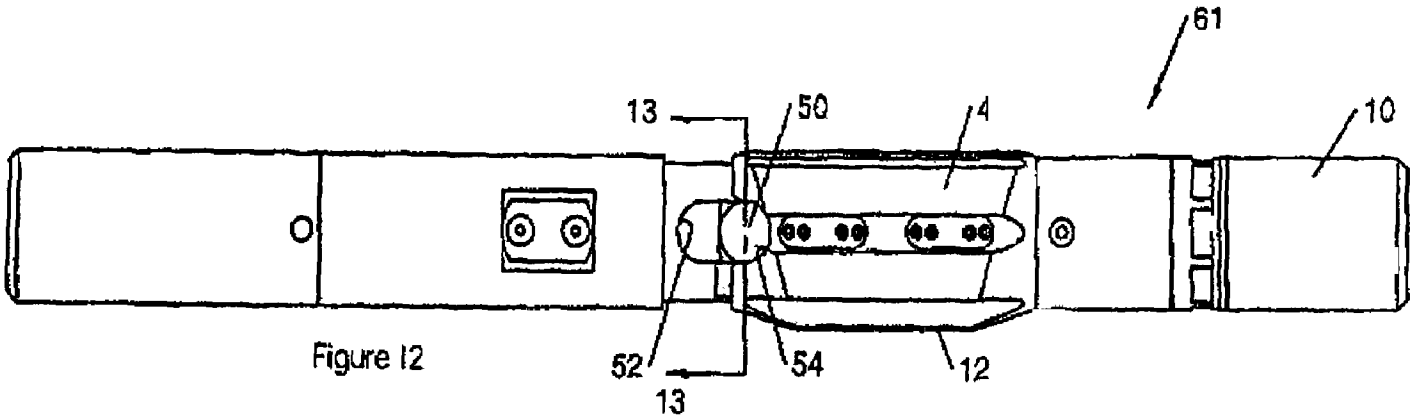
FIG. 12 is a side view of the locking mechanism at FIG. 11.
Figure 13:
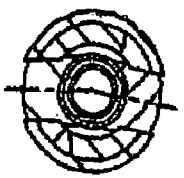
FIG. 13 is a cross-section on the line 13—13 of FIG. 12.

FIGS. 12 and 15 also illustrate the construction of a flex coupling 61, referred to above. The flex coupling 61 comprises a loose splined connection 62 between an upstream portion 63 and a downstream portion 61 of the mandrel 10, and provides 1 to 5 degrees, and preferably 3 degrees, of lateral movement or "wobble" from the rotational axis X—X of the upstream portion 63 of the mandrel 10.

The splined connection 62 is sealed by a "top hat" shaped tubular resilient element 65 which is connected by means of fluid tight seals 66, 67 to the upstream portion 63 and downstream portion 64 of the mandrel 10. The resilient element 65 may be made, for example, from an elastomer, from natural rubber or from a plastics material.

In addition to or instead of providing a fluid tight seal to the splined connection 62, the resilient element 65 biases the flex coupling into alignment with the rotational axis X—X of the upstream portion 63 of the mandrel 10. This resilient biasing could be provided by other shapes of resilient element, such as a solid cylindrical element.

Figure 16:
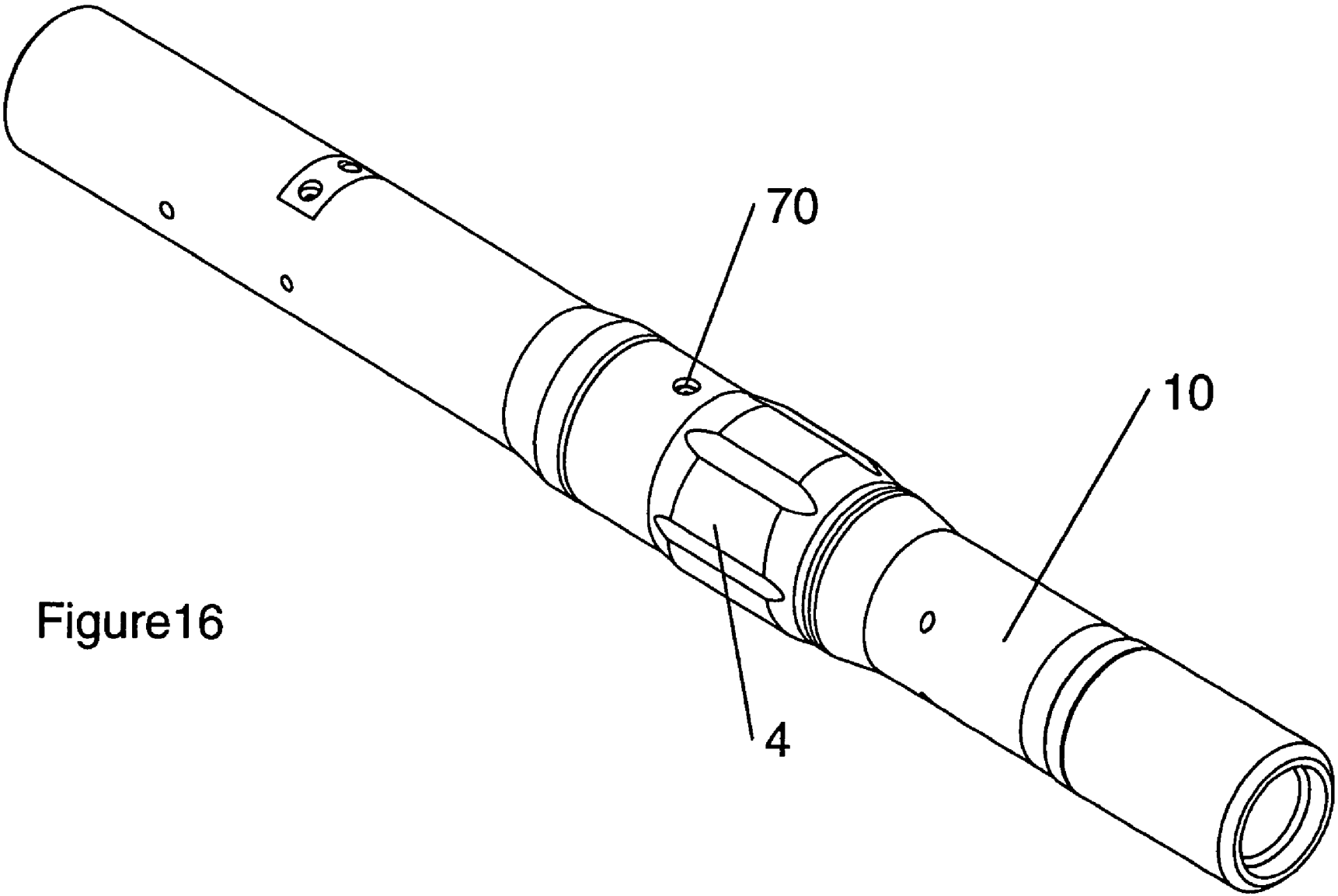
FIG. 16 shows an alternative embodiment of locking arrangement for a sleeve attached to the mandrel of a drill string.
Figure 19:
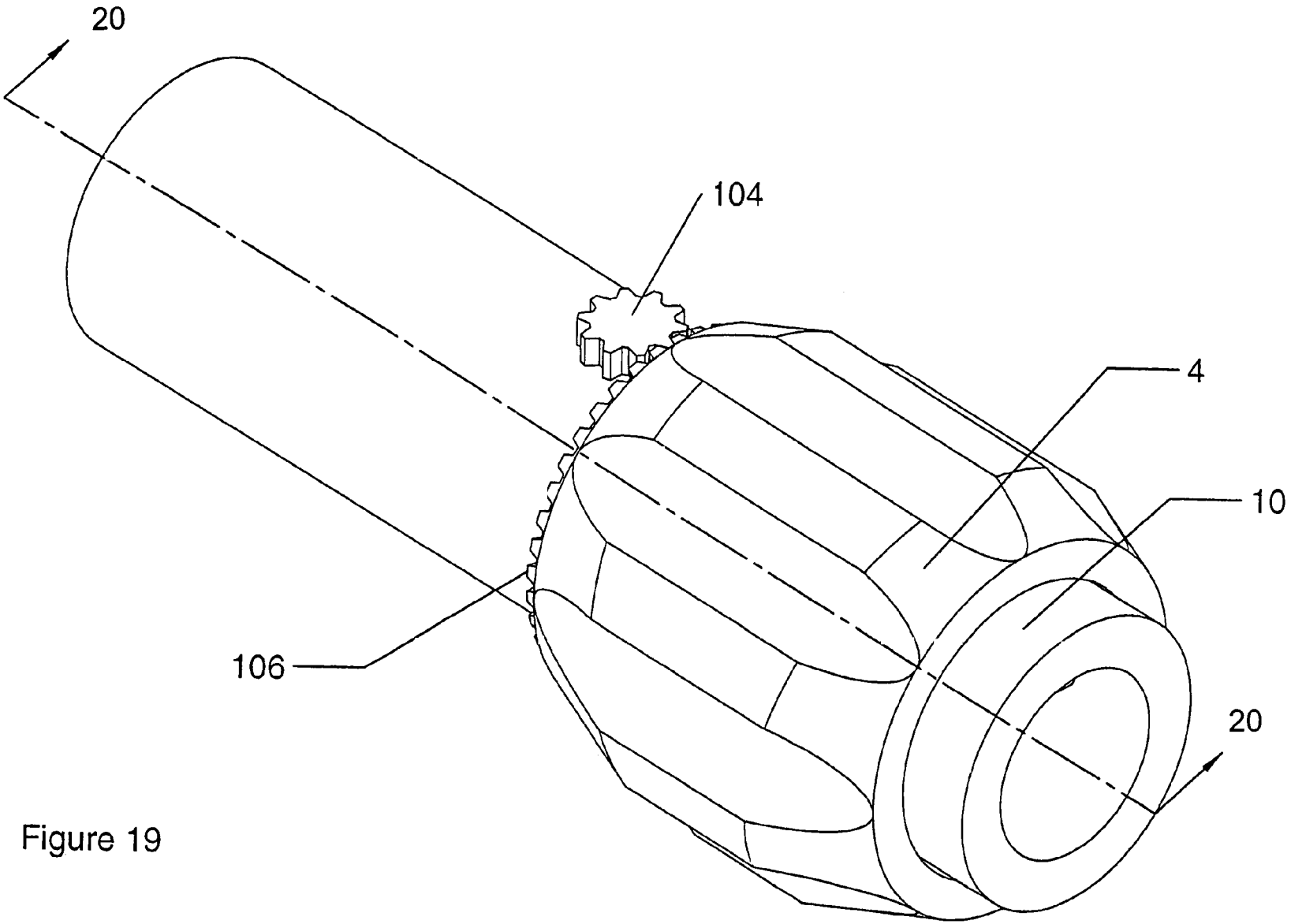
FIG. 19 is a perspective view of an alternative drive arrangement for controlling the relative rotation between a sleeve and the mandrel of a drill string.
Figure 22:
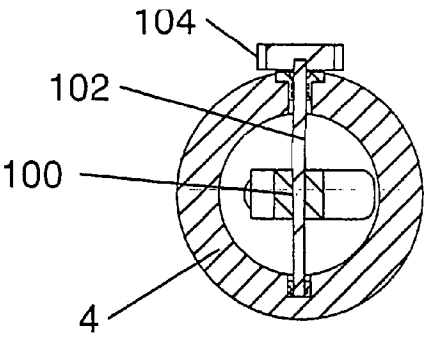
FIG. 22 is a cross-section on the line 22—22 of FIG. 20.
Figure 20:
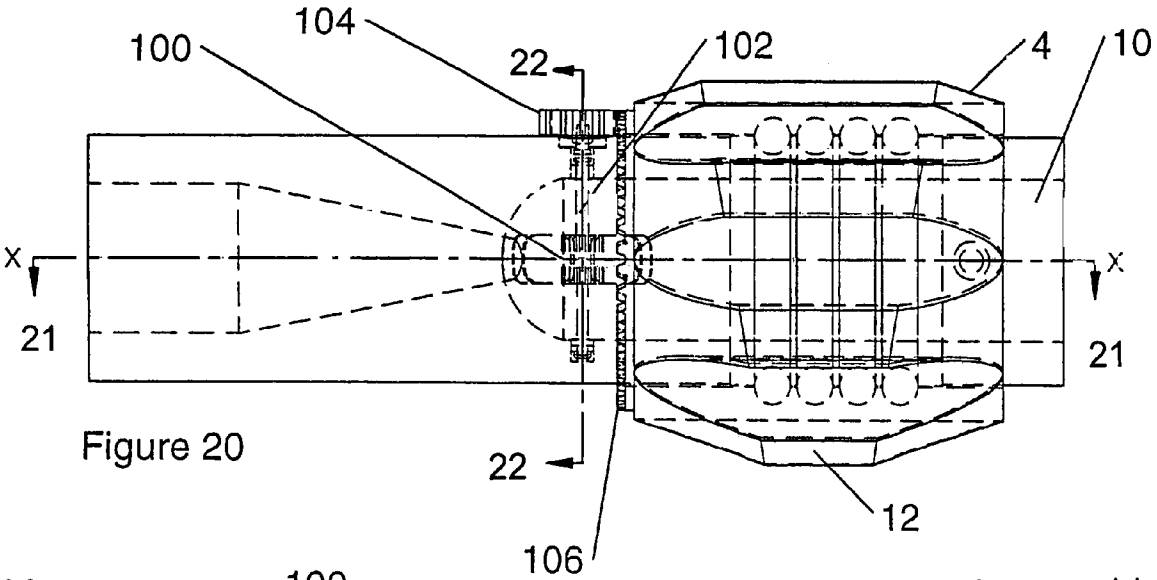
FIG. 20 is a cross-section on the line 20—20 of FIG. 19.

FIGS. 16, 17 and 18 illustrate an alternative arrangement in which a "push-on push-off" downhole mechanism is operable to force pins 70, 72 into corresponding openings 74, 76 in an offset sleeve 4. In order to facilitate the movement of the pins 70, 72 in a direction substantially parallel to the rotation axis X—X of the mandrel 10, the pins 70, 72 may be mounted in bushes or bearings (not shown) housed in the mandrel 10.

The actuating mechanism comprises a piston 82 which is driven along the rotational axis X—X of the mandrel 10 in a downhole or uphole direction against a return spring 84 by changes of internal fluid pressure within the hollow interior 86 of the mandrel 10. Recesses 88, 90 are formed in opposite sides of the piston 82 and act as camming surfaces on which the pins 70, 72 ride.

When the piston 82 is positioned such that the recesses 88, 90 are aligned with the pins 70, 72, the pins are forced under the action of springs 92, 94 to drop down into the recesses 88, 90 and thereby are retracted from the openings 74, 76 formed in the offset sleeve 4.

In an unlocked configuration, the offset sleeve 4 comes to rest in the borehole and the mandrel 10 is free to rotate in it. It however a pulse of fluid pressure is applied within the mandrel 10 to the piston 82, the piston is driven along the rotational axis X—X of the mandrel 10. As this occurs, the inner ends of the pins 70, 72 ride up the edges of the recesses 88, 90 and are driven into the openings 74, 76 formed in the offset sleeve 4. This causes the offset sleeve 4 to be locked relative to the mandrel 10 and therefore to rotate with it. It will be appreciated that by again changing the internal fluid pressure in the mandrel 10, the piston 82 will be moved back along the rotational axis X—X of the mandrel 10 such that the recesses 88, 90 again align with the pins 70, 72, so that the pins drop back out of the holes to release the offset sleeve 4.

In this embodiment, two pins 70, 72 are used. However, any number and combination of pins is contemplated.

It will be appreciated that if two pins are used and the pins are spaced 180 degrees apart, it is possible for the pins to align in two positions in a 360 degree rotation of the offset sleeve 4 relative to the mandrel 10. Consequently, in the absence of any other indication, it would not be possible to ensure that the offset sleeve 4 had been locked in the correct position relative to the mandrel 10 and hence that the angle of drilling was correct. This problem is addressed in this embodiment by offsetting the pins and using pins of different diameters so that the pins can only align in one position in a 360 degree rotation of the offset sleeve 4 relative to the mandrel 10. In an alternative embodiment, not illustrated, in addition or instead of offsetting the pins or using pins of different diameters, the pins can be staggered, such that they are asymmetrically disposed about the rotational axis X—X of the mandrel 10. This again only allows alignment in one relative position between the offset sleeve 4 and the mandrel 10.

The locking arrangements described above in relation to direct locking of an offset sleeve can also be used to lock a slave sleeve as described in the earlier embodiments. Furthermore, the mechanisms which have been described to force pins in and out of engagement with the offset sleeve could be used to apply a brake pad to an end or the underside of the offset sleeve, thereby to slow it down or bring it to rest. The braking elements could comprise conventional friction elements having substantially the form of an automotive brake shoe, but adapted for downhole use.

FIGS. 19 to 22 illustrate a further embodiment in which an offset sleeve 4 is rotated by means of an impeller 100. The impeller 100 is rotatably mounted on a drive shaft 102 which extends across the mandrel 10 in a direction perpendicular to the rotational axis X—X of the mandrel 10. The drive shaft 102 is mounted in bearings or bushes (not shown), extends through the mandrel 10 at one end, and is fixed to a gear wheel 104. A ring gear 106 formed on the end of the offset sleeve 4 adjacent the gear wheel 104 meshes with the gear wheel 104, so that drive from the impeller 100 is transferred through the gear wheel 104 to the offset sleeve 4.

Figure 21:
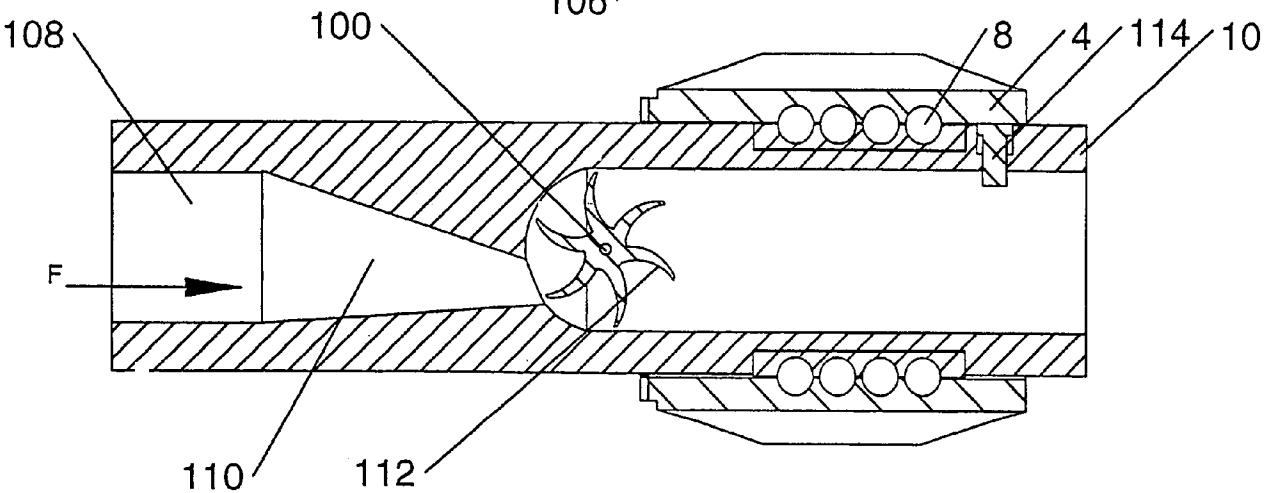
FIG. 21 is a cross-section on the line 2 1—21 of FIG. 20.

In the course of normal drilling operations, drilling fluid is pumped through the hollow interior 108 of the mandrel 10 towards the drill bit (not shown) in the direction of the arrow F in FIG. 21. In the illustrated embodiment, the hollow interior 108 of the mandrel 10 is reduced gradually in diameter to form a venturi 110 which directs the drilling fluid onto vanes 112 of the impeller 100. As the drilling fluid is forced through the venturi 110, its velocity increases, so that as the drilling fluid impinges on the vanes 112, it creates a considerable torque, lending to rotate the drive shaft 102, the gear wheel 104 and offset sleeve 4.

If the offset sleeve 4 is employed in directional drilling, a braking or locking arrangement, as described in the previous embodiments may be employed, to brake or lock the offset sleeve 4. A brake arrangement 114 is shown schematically in FIG. 21. An actuating mechanism, such as is described in the previous embodiment, can be used to selectively push the braking mechanism 114 into engagement with an underside of the offset sleeve 4, thereby to brake the sleeve relative to the mandrel 10.

The impeller 100 of this embodiment is used to rotate an offset sleeve 4, but it could be used to drive any downhole tool such as a drill bit or hydraulic pump. In addition, instead of being driven by the drilling fluid, the impeller 100 could be driven by a separate hydraulic source, for example located at the head of the borehole. Finally the impeller of the previous embodiment could be replaced with an electric or hydraulic motor.

1) Cross Shaft Linkage Drive

1i) List of Reference Numbers

6) Bearing Mounted Slave Sleeve. This can be fluted with either straight or left-handed spiral.

30) Idler Wheels

18) Cross Shaft

20) Cross-shaft Tube

4) Bearing Mounted Offset Sleeve. This can have a larger and or wider offset blade to the other blades on the tool.

10) Main Body Mandrel

61) The flexible housing body. With a through tube to aid as a restoring force.

56) Operating Mechanism (not shown) to act onto one or the other of the sleeves either a friction/braking force or locking force or allow complete freedom of movement.

1ii) Special Features of the Cross Shaft Linkage Drive

There are two idler wheels/gears assembled and connected via a cross-shaft. The cross shaft runs at right angles to the rotating axis of the mandrel body. The shaft is mounted through a static tube and therefore does not require a rotating seal. The idler wheels are mounted directly onto the body of the mandrel 180 degree apart and between both the slave sleeve and the offset sleeve. Each wheel is only connected to one of the sleeves. The two idler wheels can be of different sizes so as to cause a gearing advantage between the two sleeves and/or mechanical advantage in drive between the two sleeves. The operating mechanism can be designed to interfere with either sleeve thereby resulting in the other sleeve being driven in the opposite direction. Another feature of the design is the incorporation of a conventional one-way drive coupling between the cross-shaft and one of the idler wheels to override backward drive.

Within this concept the Slave Sleeve although concentrically mounted can be made to always makes contact with the formation at 180 deg or directly opposite from the Offset Blade on the front Sleeve. To ensure this the Offset blade on the eccentric sleeve could deploy an expandable shoe/pad whilst in the oriented/static position.

2) Separate Bearing Collar Mounted Drive

2i) List of Reference Numbers

6 Bearing Mounted Slave Sleeve. This can be fluted with either straight or left-handed spiral.

30 Idler Wheels/Gears

35 Bearing Collar for mounting the Idler Wheels

4 Bearing Mounted Offset Sleeve. This can have a larger and or wider offset blade to the other blades on the tool.

10 Main Body Mandrel

61 The flexible housing body. With a through tube to aid as a restoring force.

82 Operating Mechanism (not shown) to act onto one or the other of the sleeves either a friction/braking force or locking force or allow complete freedom of movement 2ii) Special Features of the Cross shaft Linkage Drive The centres of the Idler Wheels/Gears are not forced to rotate circumferentially at the same speed as the main body mandrel. The Idler Wheel/Gear is independently mounted. In this case the drive between the two sleeves can be shared between two or more Idler Wheels/Gears mounted on a collar that is free to rotate independently of both the sleeves and the main body mandrel. Also in this case each Idler Wheel/Gear is in contact with both sleeves at the same time. However a gear reduction could be introduced on the same Idler Wheel to differentiate the drive. Within this concept the Slave Sleeve although concentrically mounted can be made to always makes contact with the formation at 180 deg or directly opposite from the Offset Blade on the front Sleeve. Or, alternatively, the Idler Wheel/Gear Collar assembly is fitted with an Outer Ring whose Outside Diameter makes contact with the formation at 180 degrees from the Offset Blade/Pad instead of the Slave Sleeve. To ensure this the Offset blade on the eccentric sleeve could deploy an expandable shoe/pad whilst in the oriented/static position. In either case a force is applied from inside the tool to change the relative motion of the Slave Sleeve to the Rotation of the Mandrel Body.

Each of the elements:

Slave Sleeve, Collar Mounted Idlers and the Offset Sleeve may be controlled via:

A braking force or a locking force back through the mandrel body or left free to attain a steady state. One of the bearings may be designed to have less frictional effects than the other two.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A downhole tool comprising;

a first portion having a first longitudinal axis and a second portion having a second longitudinal axis, the first and second portions being connected by a joint; and a fluid tight tube having a single continuous side wall formed from a resilient material, the tube extending through the joint for conducting drilling fluid from the first portion of the tool into the second portion of the tool, the material of the tube and the thickness of the sidewall of the tube being selected such that the tube can resist internal pressure and bending and thereby apply the main straightening action to the joint, which straightening action biases the axes of the first and second portions into alignment.

2. A downhole tool as claimed in claim 1, in which the joint is flexible and allows limited articulation.

3. A downhole tool as claimed in claim 1, in which the joint comprises a loose splined connection.

4. A downhole tool as claimed in claim 1, in which the first portion comprises a first drill string section and the second portion comprises a second drill string section.

5. A downhole tool as claimed in claim 4, in which the fluid tight tube is sealed to interior surfaces of the first and second drill string sections.

6. A downhole tool as claimed in claim 1, in which the tube is made from one or more of an elastomer, a plastic material and a rubber material.

7. A downhole tool as claimed in claim 1, in which the said tube provides the only restoring force in the downhole tool which biases the joint to a straight configuration.

8. A downhole tool comprising primary and secondary sleeves which are supported for rotation relate to a mandrel of a drill string, means comprising a gear wheel being provided to transfer rotational drive from one of the sleeves to the other, the primary sleeve being spaced from and adjacent to the secondary sleeve in a longitudinal direction of the drill string.

9. A downhole tool as claimed in claim 8, in which one side of the primary sleeve projects radially outwardly further than the opposite side of the primary sleeve.

10. A downhole tool comprising;

primary and secondary sleeves which are supported for rotation relative to the mandrel of a drill string, means being provided to transfer rotational drive from one of the sleeves to the other, the said means comprising;

two gear wheels mounted on a drive shaft which passes through the mandrel, one of the gear wheels engaging only a gear formed on the primary sleeve and the other gear wheel engaging only a gear formed on the secondary sleeve.

11. A downhole tool comprising:

primary and secondary sleeves which are supported for rotation relative to a mandrel of a drill string, means being provided to transfer rotational drive from one of the sleeves to the other; and, means for locking at least one of the sleeves relative to the mandrel, the means comprising a plurality of pins, the pins being at least one of: a different size, spaced apart in a direction parallel to a rotational axis of the mandrel and spaced apart asymmetrically around the circumference of the mandrel, a pin housed in the mandrel engages in an opening in the sleeve to lock the sleeve relative to the mandrel.

12. A downhole tool comprising;

primary and secondary sleeves which are supported for rotation relative to a mandrel of a drill string, means being provided to transfer rotational drive from one of the sleeves to the other and, means for locking or braking one or both sleeves relative to the mandrel, in which said means comprises at least one pin which is driven radially outwardly into engagement with the sleeve by an actuating mechanism, in which the or each pin is driven in a direction substantially parallel to the rotational axis of the mandrel by the actuating mechanism.

13. A downhole tool comprising;

primary and secondary sleeves which are supported for rotation relative to a mandrel of a drill string, means being provided to transfer rotational drive from one of the sleeves to the other and, means for locking or braking one or both sleeves relative to the mandrel, in which said means comprises at least one pin which is driven radially outwardly into engagement with the sleeve by an actuating mechanism, in which the actuating mechanism is operated by changes in fluid pressure applied to the bore hole.

14. A downhole tool comprising;

primary and secondary sleeves which are supported for rotation relative to a mandrel of a drill string, means being provided to transfer rotational drive from one of the sleeves to the other and, means for locking or braking one or both sleeves relative to the mandrel, in which said means comprises at least one pin which is driven radially outwardly into engagement with the sleeve by an actuating mechanism, in which the actuating mechanism is operated by means of an impeller located within a flow of fluid within the mandrel.

* * * * *